US005167601A

United States Patent [19]

Frappier

[11] Patent Number: 5,167,601

[45] Date of Patent: Dec. 1, 1992

[54] SPRINTER LEG MUSCLE TRAINING DEVICE AND METHOD

[75] Inventor: John P. Frappier, Fargo, N. Dak.

[73] Assignee: Red River Valley Sports Medicine Institute, Fargo, N. Dak.

[21] Appl. No.: 466,949

[22] Filed: Jan. 18, 1990

[51] Int. Cl.[5] ..... A63B 21/00

[52] U.S. Cl. ..... 482/121; 482/74; 482/129

[58] Field of Search ..... 272/70, 135, 136, 137, 272/138, 139, 142, 143, 75, 77, 71, DIG. 7, 96; 128/25 R

[56] References Cited

U.S. PATENT DOCUMENTS

| | | | |
|---|---|---|---|
| Re. 32,547 | 11/1987 | Reed et al. | 119/29 |
| 3,659,846 | 5/1972 | Kanicki | 272/136 |
| 3,677,543 | 7/1972 | Richardson | 272/136 |
| 3,680,552 | 8/1972 | Bell et al. | 128/84 C |
| 3,976,057 | 8/1976 | Barclay | 128/25 R |
| 3,999,752 | 12/1976 | Kupperman et al. | 272/126 |
| 4,019,734 | 4/1977 | Lee et al. | 272/137 |
| 4,026,548 | 5/1977 | Birdwell | 272/136 |
| 4,026,549 | 5/1977 | Gunn | 272/137 |
| 4,047,714 | 9/1977 | Powell | 272/116 |
| 4,059,265 | 11/1977 | Wieder et al. | 272/137 |
| 4,340,218 | 7/1982 | Wilkinson | 272/70 |
| 4,469,324 | 9/1984 | Dolan | 272/70 |
| 4,544,155 | 10/1985 | Wallenbrock et al. | 272/136 |
| 4,685,671 | 8/1987 | Hagerman et al. | 272/139 |
| 4,733,862 | 3/1988 | Miller | 272/137 |
| 4,763,901 | 8/1988 | Richer | 273/29 R |
| 4,815,731 | 3/1989 | Suarez et al. | 272/139 |
| 4,909,505 | 3/1990 | Tee | 272/136 |
| 4,948,117 | 8/1990 | Burke | 272/71 |

*Primary Examiner*—Richard J. Apley
*Assistant Examiner*—Jerome Donnelly
*Attorney, Agent, or Firm*—Faegre & Benson

[57] ABSTRACT

A leg muscle training device comprises an elongated elastomeric and stretchable tether, a set of leg bindings secured to each end of the tether, and a position adjustable attachment means connected to the tether. Each set of leg bindings includes a thigh binding and a calf binding. The attachment means is designed to provide stationary resistance for the device to provide resistance for the runner moving away from the stationary resistance. The attachment means is preferably a position adjustable loop, and the means for providing stationary resistance is to have a person, such as the trainer, position the loop over the forearm and grasp the lengths of the tether firmly while the runner is moving or exerting motion away, as by running on a treadmill or in place. A method for strengthening and training a runner comprises securing the leg bindings of the device of this invention to both legs of a runner and securing the attachment means of the device to a stationary point of attachment. The runner then provides running exertion away from the point of attachment, as by running in place or on a treadmill.

5 Claims, 3 Drawing Sheets

SPRINTER LEG MUSCLE TRAINING DEVICE AND METHOD

FIELD OF THE INVENTION

This invention relates to a device for strengthening and training the leg muscles of a runner. This invention also relates to a method for providing a specific training protocol for sprinters and other athletes involved with sprint running utilizing the present novel device.

BACKGROUND OF THE INVENTION

Detailed anatomical study and training work with running athletes conducted by the present inventor has indicated that certain identifiable leg muscles, particularly the hip flexor muscle group, require specialized strengthening and training to enable the runner to achieve maximum speed and effectiveness. In the course of this study and work, this inventor has developed an overall training regimen for these muscle groups which is particularly effective for sprinters and other athletes involved with sprint running. Sprint running is often involved in such sports as football, soccer, basketball, and the like, and the leg muscle training device and method of the present invention is particularly effective in improving the strength and overall performance of athletes involved in such sports.

SUMMARY OF THE INVENTION

This invention provides a leg muscle training device which comprises an elongated elastomeric and stretchable cord, a set of leg bindings secured to each end of the cord, and a position adjustable attachment means connected to the cord. Each set of leg bindings includes a thigh binding, for providing secure, releasable attachment to the thigh, and a calf binding, for providing secure, releasable attachment to the calf. The attachment means is designed to provide stationary attachment for the device to provide resistance for the runner moving away from the stationary attachment. The thigh binding comprises an adjustable padded band for closely encircling a thigh with means for securely and releasably retaining the band in position during use. The calf binding comprises an adjustable padded band for closely encircling a calf with means for securely and releasably retaining the band in position. The attachment means is preferably a position adjustable loop, and the presently preferred means for providing stationary attachment is to have a person, such as the trainer, position the loop over his forearm and grasp the lengths of the cord firmly while the runner is moving or exerting motion away, as by running on a treadmill or in place.

This invention also provides a method for strengthening and training a runner comprising securing the leg bindings of the device of this invention to both legs of a runner and securing the attachment means of the device to a stationary point of attachment. The runner then provides running exertion away from the point of attachment, as by running in place or on a treadmill. The presently preferred method of providing stationary attachment is to have a person grasp a position adjustable loop provided on the cord.

DETAILED DESCRIPTION OF THE INVENTION

Figure 1:
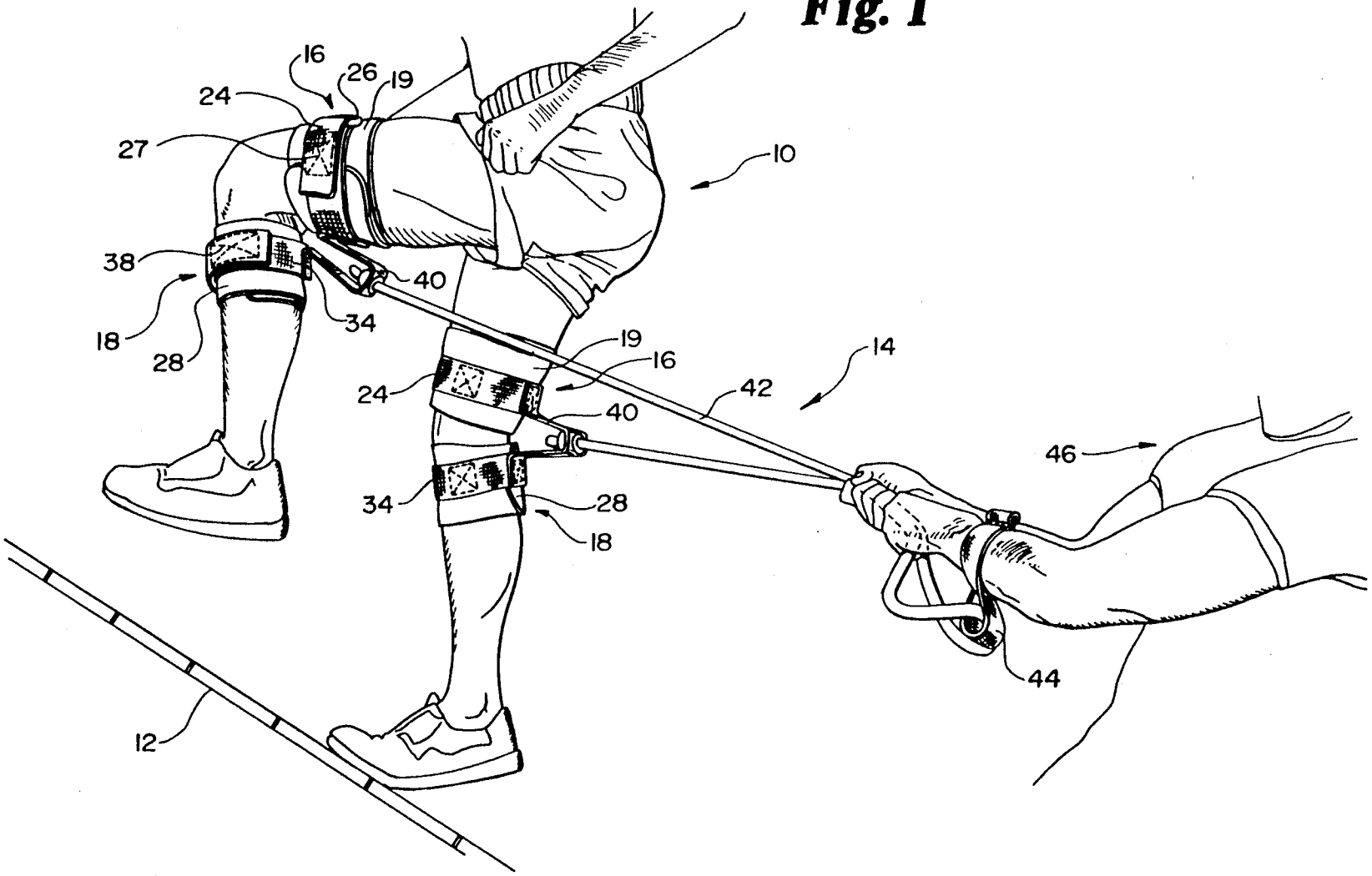
FIG. 1 is a left side perspective view of the sprinter leg muscle training device of this invention, showing it in position on an athlete for training.
Figure 2:
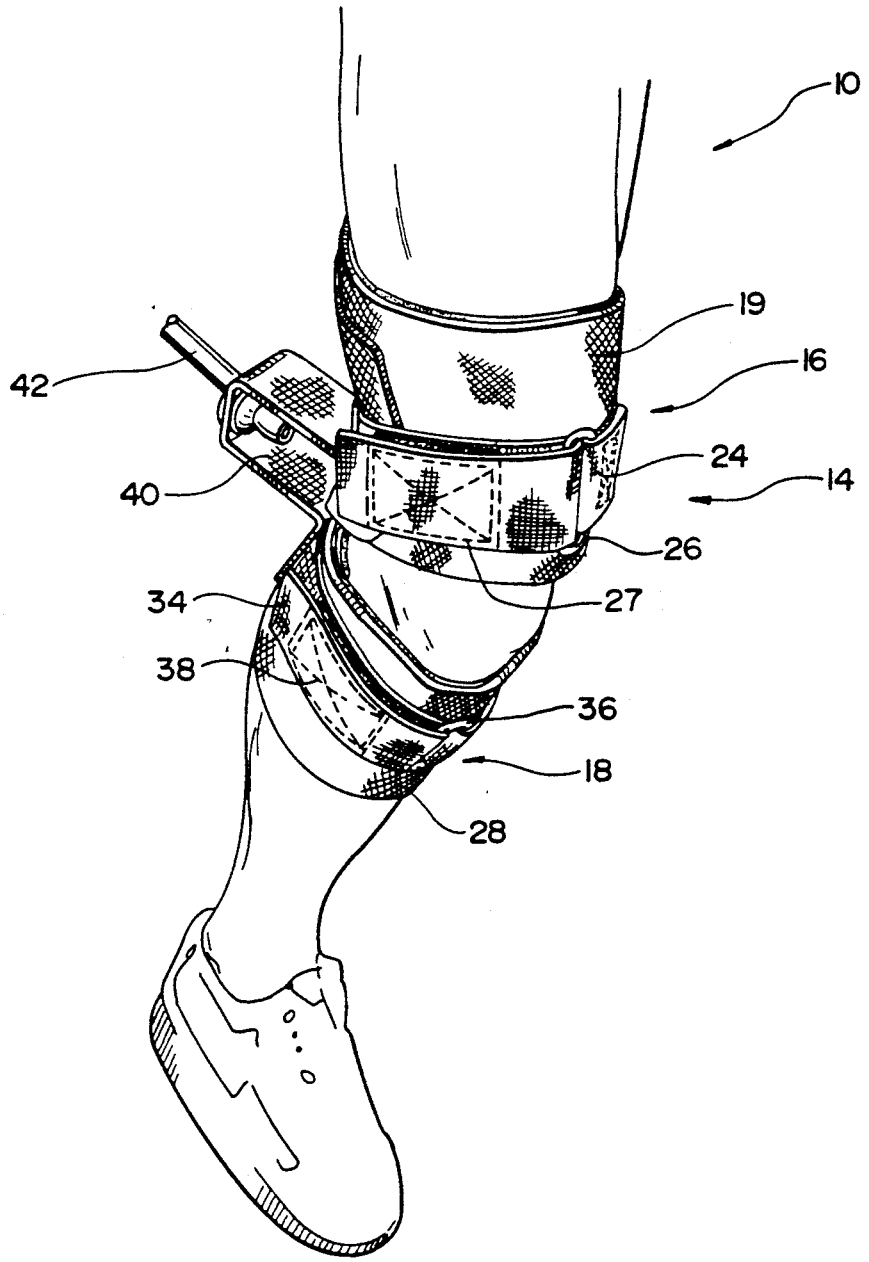
FIG. 2 is a fragmentary perspective view of the right leg portion of the present inventive training device.
Figure 3:
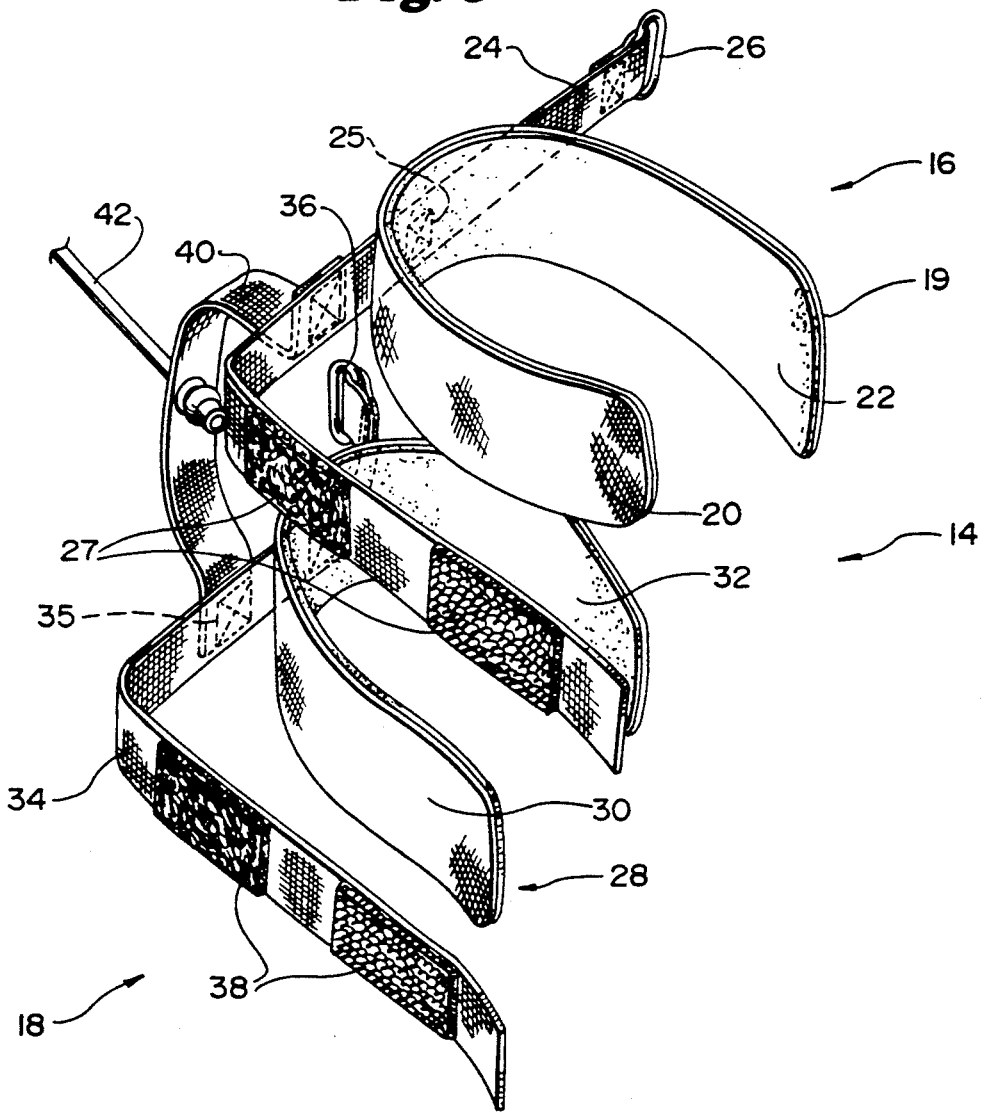
FIG. 3 is a fragmentary perspective view of the structural elements used on the right leg, showing the training device unfastened.

FIG. 1 shows sprint runner 10 running on positive grade treadmill 12 with sprinter leg muscle training device 14 of the present invention in position for training. Training device 14 is shown, in FIGS. 1 and 2, as attached to each leg of runner 10 by means of a set of leg bindings comprising thigh binding 16 and calf binding 18. Thigh binding 16 preferably comprises padded band 19 for adjustably and closely encircling the leg of runner 10. Thigh binding 16 is preferably formed on exterior 20 with a stretch fabric, such as SPANDEX expandable fabric and on interior leg-confronting side 22 with a foam padding. Thigh binding 16 may be secured to the leg of runner 10 by any suitable means. As shown in the illustrations, thigh binding 16 is secured to thigh belt 24, for example by tack stitching 25. Thigh belt 24 may be formed of a sturdy webbing with ring 26 secured at one end. The opposite end of thigh belt 24 may be provided with both hook and wool forms of VELCRO reusable closure 27, so that thigh belt 24 is threaded through ring 26 and secured back upon itself to securely fasten thigh binding 16 in position on runner 10.

Calf binding 18 is formed similarly to thigh binding 16. Calf binding 18 preferably comprises padded band 28 for adjustably and closely encircling the leg of runner 10. Calf band 28 is preferably formed on exterior 30 with a stretch fabric, such as SPANDEX expandable fabric and on interior leg-confronting side 32 with a foam padding. Calf binding 18 may be secured to the leg of runner 10 by any suitable means. As shown in the illustrations, calf band 28 is secured to calf belt 34, for example by tack stitching 35. Calf belt 34 may be formed of a sturdy webbing with ring 36 secured at one end. The opposite end of calf belt 34 may be provided with both hook and wool forms of VELCRO reuseable closure 38, so that calf belt 34 is threaded through ring 36 and secured back upon itself to securely fasten calf binding 18 in position on runner 10.

Calf binding 18 and thigh binding 16 may be attached to each other by any suitable means. As shown in the illustrations, they may be attached to each other by means of connector web 40 of sufficient length to accommodate runners 10 of different heights and leg diameters and to allow for ease of motion in running. Each connector web is attached to either end of an elongated elastomeric and stretchable cord 42. Elastomeric cord 42 should exhibit such desirable physical properties as flexural yield strength, flexural elastic modulus, tensile strength, elongation and elastic recovery. According to the presently preferred embodiment, polyurethane surgical tubing has been found to be suitable under actual extended use conditions.

Cord 42 is also provided with a position adjustable means for providing attachment of training device 14 to a stationary support means. As shown in FIG. 1, the presently preferred position adjustable means is closed loop 44 of a suitable webbing material. Also as shown in FIG. 1, the presently preferred means of providing stationary support for the device of the present invention is to have a person, such as trainer 46, slip loop 44 over his forearm and firmly grasp the extending lengths of cord 42 as runner 10, wearing training device 14, provides running exertion by running in place or on treadmill 12.

According to the present invention, the method of using the inventive device for strengthening and training a runner comprises the following steps. Using training device 14 as just previously described, the set of leg bindings, each comprising thigh binding 16 and calf binding 18, is secured around each leg of runner 10. Closed loop 44, which is adjustably positioned on cord 42 is attached to a stationary point of attachment. As just previously described, the presently preferred method of providing stationary attachment is to have trainer 46 place the loop 44 over his forearm and securely grasp the extending lengths of cord 42 as runner 10 provides running exertion, as by running in place or on a treadmill.

Using the device and the method of the present invention in conjunction with a systematic, extended training program, remarkable and demonstrable increase in strength, speed and overall performance of sprint runners has been achieved. The present invention has demonstrated success in training of normal, healthy athletes, as well as in athletic rehabilitation of injured athletes. It will be apparent to those of skill in this area, that this device and method can be easily adjusted to the needs of the individual athlete by providing different lengths and degrees of resistance in the cord or tether against which the runner exerts running or movement effort.

What is claimed is:

1. A leg muscle training device comprising:

a resilient and extensible elongate tether having a first end and a second end;

two sets of separate and independent leg bindings each having a connection means for securing one set to either end of said tether, each set of leg bindings further comprising a separate and independent thigh binding for attachment to a thigh and a separate and independent calf binding for attachment to a calf; and restraint means connected to said tether, configured to allow attachment of said restraint means to an adjacent resistance means.

2. A leg muscle training device according to claim 1, wherein the thigh binding comprises a band for encircling a thigh with means for retaining the band thereabout, and wherein the calf binding comprises a band for encircling a calf with means for retaining the band thereabout and wherein the restraint means is attached to a stationary means for providing resistance for the legs of a runner moving or exerting motion away from the stationary means.

3. A leg muscle training device according to claim 1, wherein the restraint means is a position adjustable closed loop.

4. A leg muscle training device comprising:

a stretchable and retractile elongate cord of elastic resinous material characterized by a property of elongating from a resting length undor influence of a pulling force thereon and returning to said resting length upon release of said pulling force, said cord having a first end and a second end;

two sets of separate and independent leg bindings each having a connection means for securing one set to either end of said cord, each set of leg bindings further comprising a separate and independent thigh binding and a separate and independent calf binding for securing to thigh and calf, respectively, of both legs of a runner; and restraint means connected to said cord, said restraint means comprising a closed loop to be retained by a resistance means to provide exerting resistance for said runner.

5. A leg muscle training device according to claim 4, wherein the thigh binding comprises an adjustable band for encircling a thigh with means for securely and releasable retaining the band thereabout on said person, and wherein the calf binding comprises an adjustable band for encircling a calf with means for securely and releasable retaining the band thereabout on said person, and wherein the resistance means is a stationary means providing exertion resistance for the legs of the person moving or exerting motion away from the stationary means.

* * * * *

UNITED STATES PATENT AND TRADEMARK OFFICE

CERTIFICATE OF CORRECTION

PATENT NO. : 5,167,601

DATED : December 1, 1992

INVENTOR(S) : John Frappier

It is certified that error appears in the above-identified patent and that said Letters Patent is hereby corrected as shown below:

In claim 4, column 4, line 21, the spelling of--under--should be corrected.

Signed and Sealed this

Twenty-fifth Day of January, 1994

*Attest:*

Bruce Lehman

BRUCE LEHMAN

*Attesting Officer*

*Commissioner of Patents and Trademarks*